United States Patent [19]

Van Note

[11] 4,424,650

[45] Jan. 10, 1984

[54] ROOF INSULATION SYSTEM AND METHOD

[76] Inventor: Paul L. Van Note, 1990 Starkey Rd., Largo, Fla. 33541

[21] Appl. No.: 291,231

[22] Filed: Aug. 10, 1981

[51] Int. Cl.[3] ..... E04B 7/00

[52] U.S. Cl. ..... 52/96; 52/63; 52/309.8; 52/404; 52/411; 52/747

[58] Field of Search ..... 52/411, 408, 409, 96, 52/747, 63, 222, 3, 404, 309.9, 309.8, 410, 748

[56] References Cited

U.S. PATENT DOCUMENTS

| | | | |
|---|---|---|---|
| 3,468,086 | 9/1969 | Warner | 52/748 X |
| 4,045,922 | 9/1977 | Elliott | 52/408 X |
| 4,162,597 | 7/1979 | Kelly | 52/410 |
| 4,223,487 | 9/1980 | St. Clair | 52/309.8 |
| 4,259,817 | 4/1981 | Elliott | 52/408 X |
| 4,288,951 | 9/1981 | Carlson et al. | 52/404 X |
| 4,288,964 | 9/1981 | Petersen | 52/408 X |

*Primary Examiner*—Carl D. Friedman
*Attorney, Agent, or Firm*—Frijouf, Rust & Pyle

[57] ABSTRACT

An improved roof insulation system and method is disclosed for a building having a sidewall and an upper supporting surface. The insulation system includes a first substantially rigid insulation disposed about the periphery of the upper surface of the building. A second flexible insulation is disposed within the central area defined by the first rigid insulation thereby insulating the entire upper supporting surface of the building. A flexible waterproof covering is located upon the first and second insulations with the first insulation supporting the periphery of the waterproof covering and with the second insulation supporting the central area of the waterproof covering. Flashing is secured by mechanical fasteners to seal the terminal ends of the waterproof covering to the building about the periphery of the upper supporting surfaces thereby producing a waterproof insulating roof system.

22 Claims, 10 Drawing Figures

ROOF INSULATION SYSTEM AND METHOD

BACKGROUND OF THE INVENTION

1. Field of the Invention

This invention relates to building structures and more particularly to an insulating roof system.

2. Background of the Prior Art

Various types of roofing systems have been developed by the prior art for numerous types of building structures. Most of these devices have been specifically designed for a particular need and have met with various degrees of success in the art.

U.S. Pat. No. 2,345,221 to G. E. Swenson, demonstrates the application of a corrugated sheet with an insulating board secured thereto by nails overlaid by a surface coating and a finishing board.

U.S. Pat. No. 2,861,525 to F. W. Curtis et al, demonstrates the use of a fire retardant roof and vapor barrier whereby a sheet metal roof is overlaid by a non-combustible adhesive for affixing an insulating layer thereon. A waterproofing surface layer is then affixed to the insulating layer.

U.S. Pat. No. 2,895,432 issued to J. H. Bowman, shows a roof system for a sheet metal roof provided with laterally spaced parallel folds projecting downward with a thermal insulation covering the metal deck and fastened thereto by nails driven through the insulation into clips engaging the fold of the sheet metal roof.

U.S. Pat. No. 3,177,618 to B. M. Jacobs teaches the use of prefabricated panels for an A-frame construction with each panel including separate layers of sheeting filled with an insulating material.

U.S. Pat. No. 3,307,306 to R. E. Oliver incorporates an insulating structure employing an adhesive for providing a vapor-tight bond between adjacent vapor barriers of adjacent insulators.

U.S. Pat. No. 3,365,847 to A. Josek demonstrates the use of edge flashing for a roof providing a waterproof seal for the thermal extensions of butt joint and the like.

U.S. Pat. No. 3,404,495 to E. Simpson, Jr. illustrates the use of a combined flashing and fascia system and method incorporating an L-shaped fascia for sealing the terminating edge of a roofing system.

U.S. Pat. No. 3,483,664 to S. A. Funk et al illustrates a reinforced plastic roofing sheet with an underlay of open cell plastic foam.

U.S. Pat. No. 3,585,766 to S. Leslie Jamieson relates to a flashing construction for a flat roof wherein a flexible waterproof flashing membrane is secured to an upper edge of a seat and adapted to cover the cant and merge of roofing felt to form a weathertight flashing construction.

U.S. Pat. No. 3,680,269 to Harry S. Fisher et al demonstrates a fascia plate for a substantially horizontal roofing support wherein the fascia plate includes a slot for receiving a flexible impervious flash strip, a part of which is sealed by asphalt to the roofing material.

U.S. Pat. No. 3,729,884 to R. S. Dunn et al teaches a method of roof construction utilizing a flexible roof cover sheet and a roof locking member which is rotated to stretch the cover sheet in a lateral direction to rigidly fasten the cover sheet to the building structure.

U.S. Pat. No. 3,760,546 to Gerald Martin et al discloses a modular roof construction whereby roof modules may be joined together to overlay portions of the central trusses for nailing.

U.S. Pat. No. 3,958,873 issued to Sherman A. Stewart et al discloses a twin membrane, self-sealing, mechanically fastened, insulating roof deck system wherein spacing between insulating substrate boards are filled with insulating foam.

U.S. Pat. No. 4,045,922 to Frank S. Elliott illustrates a roof apparatus for mobile homes and the like using laminated layers of different materials to provide an insulating roof structure.

U.S. Pat. No. 4,069,628 to Charles Kreimer illustrates an eave thermal baffle insulation to prevent air and moisture from going through the eave to the insulation of the roof system.

U.S. Pat. No. 4,160,346 to John Kaufmann teaches a roof composition and construction having an insulating member of plastic foam covered with a protective sheet made of reinforced concrete covered by a weather impervious rubber structured membrane.

U.S. Pat. No. 4,233,487 to Alfred St. Clair discloses a roof construction utilizing thermal plastic panels arranged in an edge contacting relationship to span the roof underpanels.

U.S. Pat. No. 4,259,817 issued to Frank S. Elliott, together with U.S. Pat. No. 4,045,922 to Frank S. Elliott, are among the most pertinent prior art teaching the use of an insulating roof apparatus of flexible layers of different materials including insulating and sealing materials. A major disadvantage of the aforesaid patents resides in the lamination of the various elements into a unitary structure thereby necessitating the use of sophisticated equipment in order to lift the insulation to the top of the roof for installation. Further, the vapor barrier of these prior art structures are disposed adjacent to a waterproof covering material thereby providing a redundant function of a waterproof vapor barrier adjacent a waterproof covering. Further, the use of flexible insulation in proximity to the edge of the roof surface requires flashing material which extends over the top of the roof structure thereby increasing the possibility of leakage of the roofing system.

Therefore it is an object of this invention to provide an apparatus and method which overcomes the aforementioned inadequacies of the prior art devices and provides an improvement which is a significant contribution to the advancement of the roof insulation art.

Another object of this invention is to provide a roof insulating system and method incorporating two distinct types of insulation, namely a rigid insulation disposed around the outer perimeter of the roof of a building with a flexible insulating disposed in the central area of the building roof, whereby the rigid insulation provides mechanical stability and support for a waterproof covering.

Another object of this invention is to provide a roof insulating system and method wherein the rigid insulation is secured to the building structure by adhesive or similar means to provide lateral stability to the insulation system upon the roof of the building.

Another object of this invention is to provide a roof insulating system and method wherein the installation of the insulation system can be accomplished without the use of specialized tools or equipment required to lift the component elements to the roof of the building.

Another object of this invention is to provide a roof insulating system and method incorporating rigid insulation disposed in the central area of the roof of the building for providing additional support to an overlaying waterproof covering.

Another object of this invention is to provide a roof insulating system and method which is low in material and installation cost and is essentially maintenance free.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into a roof insulation system for a building having sidewalls and an upper supporting surface. The invention comprises a first substantially rigid insulation means disposed about the periphery of the upper supporting surface of the building. A second flexible insulation means is disposed within the central area defined by the first substantially rigid insulation means thereby insulating the entire supporting surface of the building. A flexible waterproof covering means is disposed upon the first and second insulation means with the first insulation means supporting the periphery of the flexible waterproof covering means with the second insulation means supporting the central area of the flexible waterproof covering means. Sealing means is incorporated within the invention for sealing the terminal ends of the waterproof covering means to the building in proximity to the outer periphery of the upper supporting surface thereby producing a waterproof insulating roof system.

In a more specific embodiment of the invention, the rigid insulation means has the characteristic of being substantially less compressible than the second flexible insulation means enabling the first insulation means to support the periphery of the waterproof covering. Preferably, the rigid insulation is secured to the upper surface of the building by means such as adhesive or the like for maintaining the lateral position of the flexible insulation means upon the upper surface of the building. In another embodiment of the invention, additional rigid insulation may be disposed within the central area defined by the periphery of the upper surface of the building for adding further support to the flexible waterproof covering.

The rigid insulation may take the form of a plurality of blocks disposed in an abutting relationship about the periphery of the upper surface of the building. The second flexible insulation preferably takes the form of at least one piece of flexible insulation such as fiberglass abutting the edge of the rigid insulation which is also preferably a rigid fiberglass insulation. The thickness of the rigid insulation is substantially less than the thickness of the second insulation enabling the covering to be slightly tapered about the terminating edges of the upper supporting surface of the building structure.

The flexible weatherproof covering is preferably of a flexible plastic material affixed to the building structure by flashing means or the like secured to the upper sidewall of the building in proximity to the periphery of the upper supporting surface.

The invention also resides in the method of forming a roof structure system of a building having an upper supporting surface including coating the periphery of the upper supporting surface with an adhesive. The method additionally comprises depositing a plurality of insulating blocks of substantially rigid insulation upon the adhesive to cover the periphery of the upper supporting surface of the building. Additional steps in the method include laying flexible insulation and more specifically, unrolling rolled insulation upon the central area of the upper supporting surface to abut the rigid insulation thereby insulating the entire area of the upper supporting surface of the building. The insulation is then covered with a waterproof covering and sealed by applying flashing or the like in proximity to the periphery of the upper supporting surface of the building. The waterproof covering material is preferably unrolled on top of the insulation enabling the method of forming the roof structure to be accomplished without the use of expensive roofing equipment to raise the component materials to the upper supporting surface of the building.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
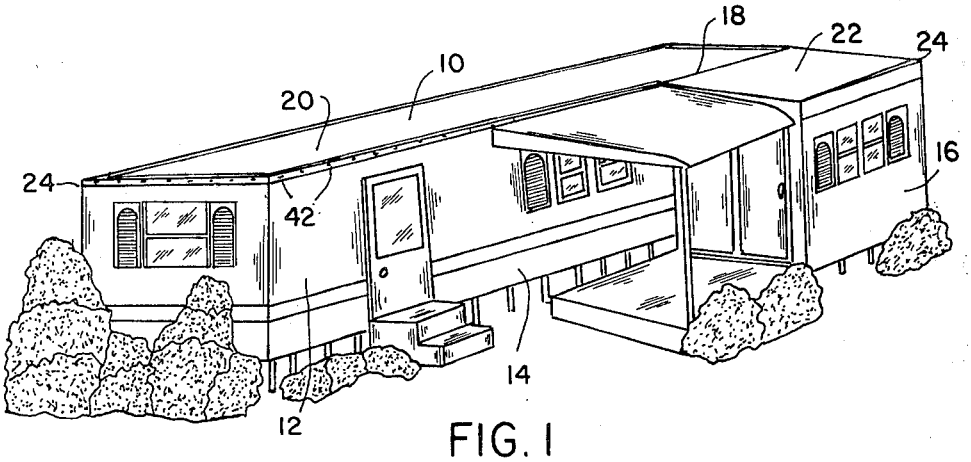
FIG. 1 is a perspective view of a building structure incorporating the improved roof insulation system.

FIG. 1 illustrates an improved roof insulation system 10 disposed upon a building 12 shown as a mobile home having a main building 14 and an annex building 16. Although the drawings show the building as a mobile home, it should be appreciated that the term "building" as used in the instant specification and claims includes any type of structure requiring an insulating roof such as mobile or permanently installed building structures as well as vehicles such as vans, sea vessels and the like. Additionally, the improved roof system may be utilized on a portion of a building in combination with a conventional roof as more fully explained with references to FIGS. 9 and 10. The roof system 10 which will be explained more fully hereinafter, is affixed to both the main building 14 and the annex building 16 with a seam 18 joining two sections of the covering 20 and 22 to form a single waterproof roof system. It should also be appreciated that although the building 12 has been disclosed as a single width mobile home, the instant invention is suitable for use on double-width mobile homes or large building structures requiring multiple seams 18. The roof structure 10 is secured by flashing 24 disposed about the periphery of the building 12.

Figure 2:
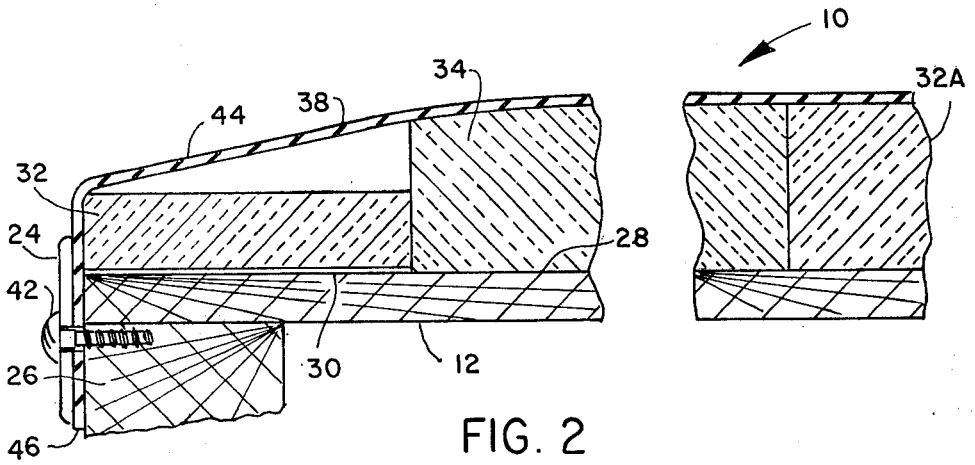
FIG. 2 is a side sectional view of a portion of the roof system shown in FIG. 1.
Figure 3:
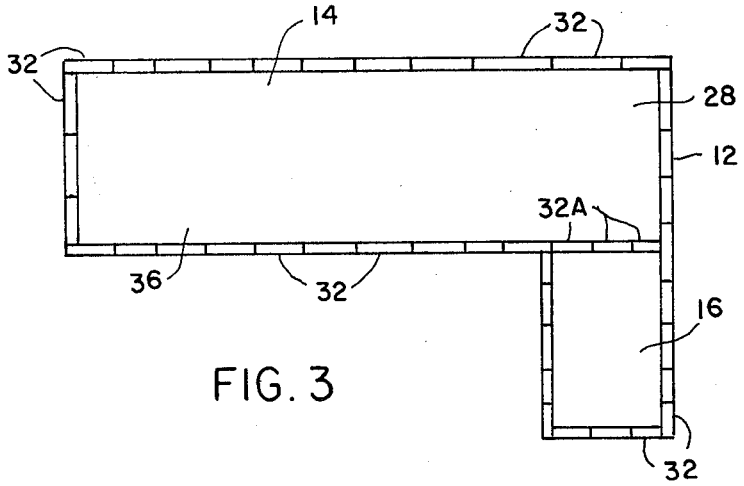
FIG. 3 is a top view of FIG. 1 illustrating the placement of the rigid insulation.

The improved roof system 10 is more fully shown in FIGS. 2 and 3 wherein the roof insulation system 10 is disposed on the building 12 having a sidewall 26 and an upper supporting surface 28 made of wood or metallic material. The invention comprises an adhesive 30 disposed on the outer periphery of the upper supporting surface 28 of the building 12 with a first substantially rigid insulation means 32 disposed on the adhesive 30. FIG. 3 illustrates a top view of the building 12 with the rigid insulation 32 disposed about the outer periphery of the main building 14 and the building annex 16. The first rigid insulation is shown as a plurality of blocks of rigid fiberglass which may be a thickness of one inch for adding mechanical strength around the periphery of the upper supporting surface 28.

A second flexible insulation means 34 is disposed within the central area 36 shown in FIG. 3, defined by the rigid insulation 32 for entirely covering the upper supporting surface 28 of the building 12. The second insulation 34 may be, for example, three and one half inches fiberglass insulation which has substantially more compressibility than the first insulation 32. The first rigid insulation 32 affixed to the upper supporting surface 28 by the adhesive 30 maintains the lateral position of the flexible insulation 34 upon the upper surface 28. The second insulation 34 abuts the edge of the first insulation 32 for providing this lateral stability. The first substantially rigid insulation 32 provides a higher insulation per unit thickness than the second flexible insulation 34.

FIG. 3 shows a plurality of first insulation blocks 32A disposed in the central area 36 of the building adding further support to a flexible waterproof covering 38. It should be appreciated by those skilled in the art that the rigid insulation may be intermittently disposed anywhere within the central area 36 to add support to the waterproof covering 38. The intermittently disposed rigid insulation 32A is more fully shown in FIG. 2.

The flexible waterproof covering means 38 is disposed upon the first and second insulations 32 and 34 with the first insulation 32 supporting the covering 38 about the periphery of the upper supporting surface 28 and with the second flexible insulation means 34 supporting the central area 36 of the waterproof covering 38. It should be appreciated by those skilled in the art that the flexible insulation 34 will be somewhat compressed by the weight of the covering means 38. The waterproof flexible covering 38 may be any type of flexible material having a waterproof characteristic with sufficient durability for a roofing covering. The inventor has determined that the product sold under the trademark "TREMPLY", by the B F Goodrich Company, having a Hypalon synthetic rubber material manufactured by DuPont, is suitable for operation of this invention. However, it should be understood that numerous other types of material may be utilized in this invention.

The flexible waterproof covering 38 is secured to the building structure by flashing 24 secured by mechanical means such as screws 42. The first rigid insulation 32 preferably has lesser thickness than the second flexible insulation 34 to provide the taper 44 as illustrated in FIG. 2. This taper 44 facilitates water drainage in addition to providing a more asethestically pleasing appearance to the roof structure 10.

The flexible waterproof covering 38 is disposed between the sidewall 26 of the building 12 and the flashing 24. A positive seal is made in this manner since the flashing 24 does not extend along the upper horizontal surface of the flexible waterproof covering 38 which was a substantial disadvantage of the prior art. The present invention provides an insulated waterproof roof which may be affixed to new or existing buildings upon support surfaces or an existing roof with minimal material and installation costs. In addition, the roof structure substantially reduces the transmission of sound through building 12.

The invention also resides in the method of forming the roof insulation system as is more fully shown in FIGS. 4–8.

Figure 4:
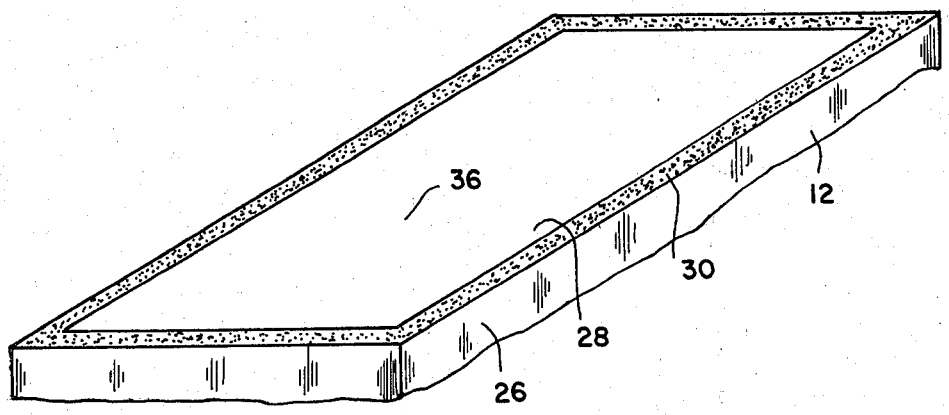
FIG. 4 illustrates a first step in the method of forming the improved roof insulation system of applying adhesive to the upper surface.

FIG. 4 illustrates the first step in the method of forming the improved roof insulation system wherein the adhesive 30 is disposed upon the outer periphery of an upper supporting surface of a building 12A.

Figure 5:
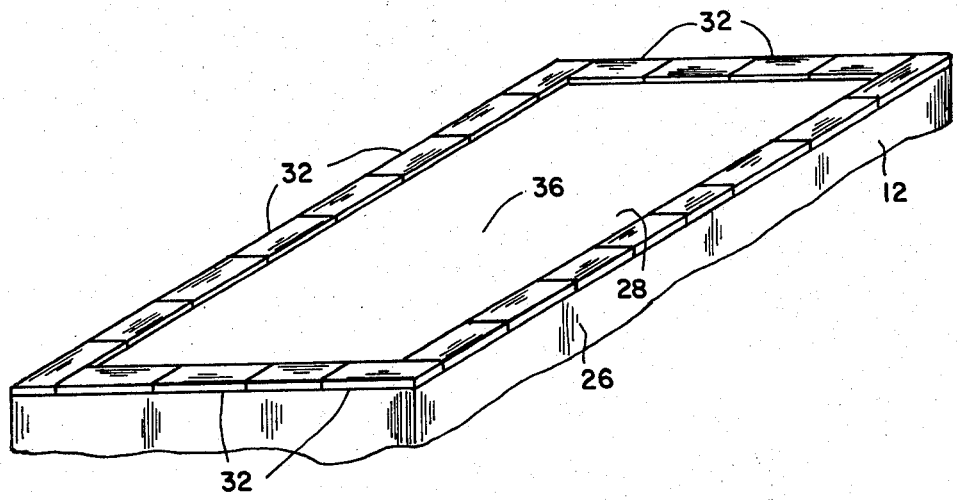
FIG. 5 illustrates a second step in the method of forming the improved roof insulation system of installing rigid insulation upon the adhesive.

FIG. 5 illustrates the second step in the method of forming the improved roof structure wherein the plurality of blocks of first rigid insulation 32 are disposed upon the adhesive 30 on the upper supporting surface. In this embodiment, the upper supporting surface 28 is void of intermittently disposed first rigid insulations 32A in the central area 36, but the same method would be applicable for use in such applications.

Figure 6:
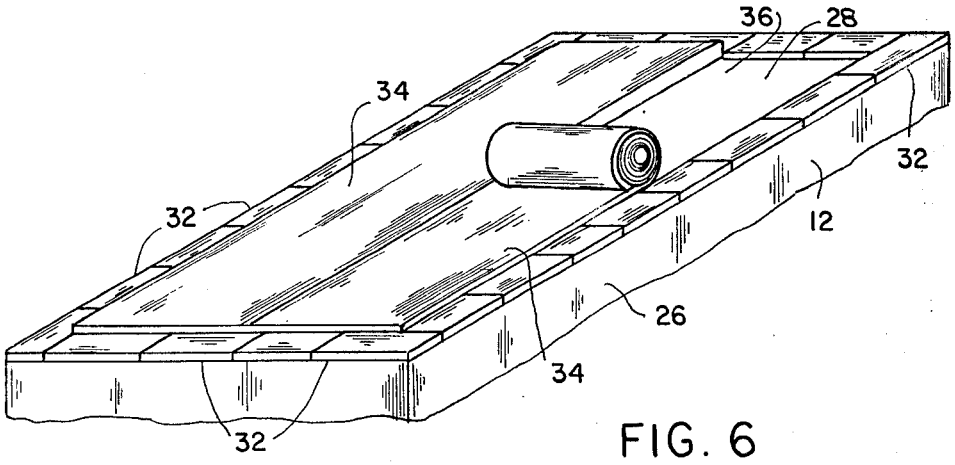
FIG. 6 illustrates the third step in the method of forming the improved roof insulation system of unrolling flexible insulation into the central area of the upper supporting surface.

FIG. 6 illustrates the third step in the method of forming an improved roof insulation system wherein the flexible insulation 34 is disposed within the central area 36 of the upper supporting surface 28. More specifically, FIG. 6 shows the flexible insulation 34 being unrolled on the upper supporting surface 28 to abut the first insulation 32 secured to the upper supporting surface 28 by the adhesive 30. The flexible insulation 34 is shown to have a greater thickness than the first rigid insulation 32 and although desirable, is not an essential aspect of the invention.

Figure 7:
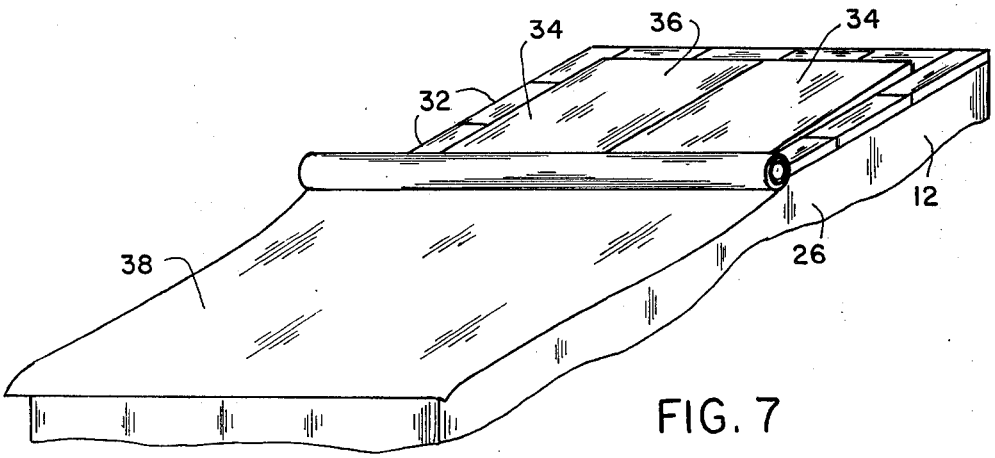
FIG. 7 illustrates the fourth step in the method of forming the improved roof insulation system of unrolling a covering material on top of the rigid and flexible insulation.

FIG. 7 illustrates the fourth step in the method of forming the improved roof insulating structure wherein the flexible waterproof covering 38 is unrolled on top of the rigid and flexible insulations. The flexible waterproof covering 38 is then cut to the approximate size of the upper supporting surface 28 such that the waterproof covering may be affixed to the building.

Figure 8:
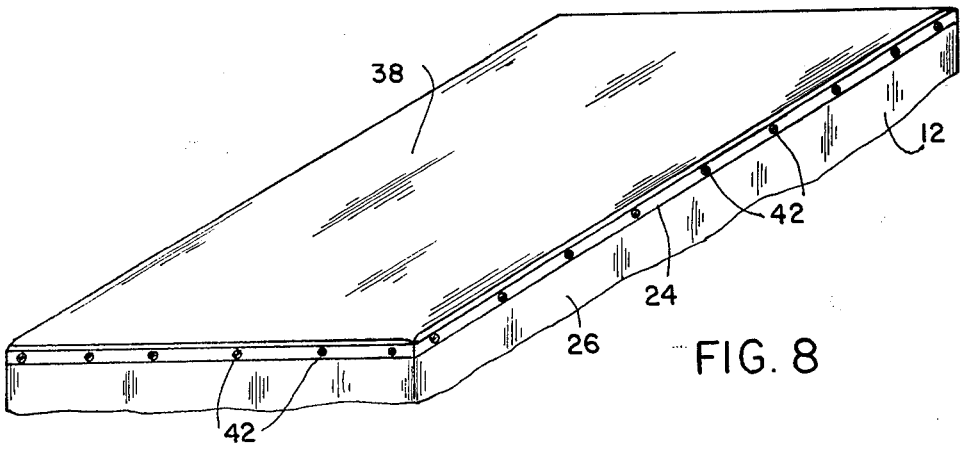
FIG. 8 illustrates the final step in the method of forming an improved roof insulation system of securing the covering material to the building structure with flashing.

FIG. 8 illustrates the final step in the method of forming the improved roof insulation system wherein the flashing 24 is secured to the upper sidewall of the building to complete the process. For roof requiring multiple widths of flexible waterproof covering 38, an additional step of creating seams between adjacent flexible waterproof covering widths is utilized, but such techniques are well known in the art and are not explicitly stated herein.

The instant method enables the insulation roof system to be fabricated on top of the upper supporting surface 28 with each of the components being separately raised to the upper surface 28. This is a distinct advantage over the prior art wherein the entire laminated system had to be lifted and installed at one time, thus requiring cranes or lifts to raise the heavy components. The present invention has eliminated the need for such equipment and has provided a low cost, low maintenance insulation system which is very beneficial to the industry.

Figure 9:
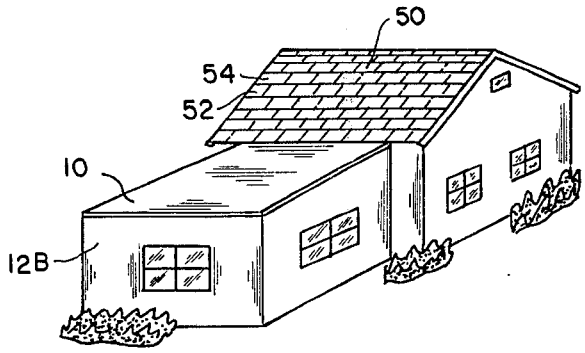
FIG. 9 is a perspective view of a building having a conventional shingled roof in combination with the improved roof insulation system.
Figure 10:
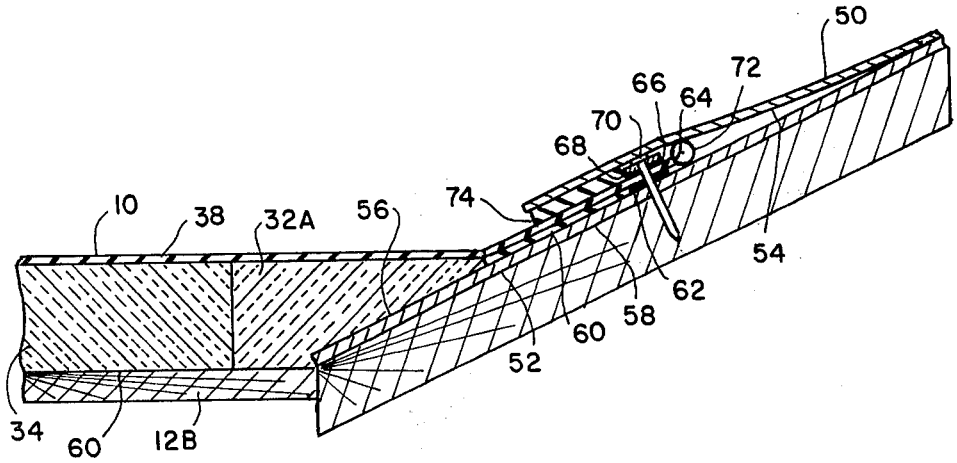
FIG. 10 is an enlarged sectional view of the juncture of the conventional shingled roof and the improved roof insulation system shown in FIG. 9.

FIG. 9 is an isometric view of the improved insulating roof system 10 being installed on a portion 12B of a building in combination with a conventional roof 50 incorporating shingles, tiles or the like. FIG. 10 is an enlarged sectional view of the juncture of the conventional roof 50 and the improved roof insulation system 10 with the conventional roof 50 being shown as a shingled roof. It should be appreciated by those skilled in the art that the shingled roof 50 may be a tile roof or any other conventional roof system. In this example, the installation of the improved roof insulating system 10 will be explained assuming the conventional roof 50 is already in position, but it should be understood that the improved roof insulating system 10 and conventional roof 50 may be installed concurrently, depending upon the particular application.

For a pre-existing conventional roof 50, one or more of the bottom rows of shingles 52 and 54 are either folded back or are removed and the flat section 12B of the improved insulating roof system 10 is installed as heretofore described.

A rigid insulation 32A is cut at 56 to cooperate with the slope 58 of the conventional roof 50 and is positioned as shown. A first layer of liquid roof sealant 60 is applied to the underside of the flexible waterproof covering 38. A first sealing tape 62, such as butyl tape or the like, is applied to the shingles or sheeting of the conventional roof structure 50 in proximity to the terminating edge 64 of the flexible waterproof covering 38. The flexible waterproof covering 38 is secured to the shingles or sheeting through the first liquid roof sealant 60 with the terminating edge 64 of the flexible waterproof covering 38 extending beyond the sealing tape 62. A second sealing tape 66, such as butyl tape or the like, is applied to the upper surface of the flexible waterproof covering 38 adjacent the first tape 62 and is secured by an aluminum flashing 68 and mechanical fasteners 70 such as roofing nails or the like. A bead of silicon sealant 72 is installed at the terminating edge 64 of the flexible waterproof covering 38 to prevent leakage. A second layer of liquid roof sealant 74 is installed on the upper surface of the flexible waterproof covering 38 and the aluminum flashing 68 to seal with the underside of the shingles 54 and to protect the flexible waterproof covering 38 therefrom. The shingles 52 and 54 may then be replaced to seal with the liquid roof sealant. In the case of a tiled roof, the tiles are replaced and sealed as required for the particular roof structure. The disclosed sealing apparatus and method provides distinct advantages to housing additions which are typically of a non-insulated structure.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, I claim:

1. A roof insulation system for a building having sidewalls and an upper supporting surface, comprising in combination:

first substantially rigid insulation means disposed about the periphery of the upper supporting surface of the building;

second flexible insulation means disposed within the central area defined by said first substantially rigid insulation means for insulating the entire upper supporting surface of the building;

flexible waterproof covering means disposed upon said first and second insulation means;

said first insulation means being substantially more rigid than said second insulation means to add mechanical strength around the periphery of the upper support surface enabling said first insulation means to support said flexible waterproof covering means from the periphery of the upper supporting surface and said second insulation means supporting said flexible waterproof covering means from the central area of the upper supporting surface; and sealing means for sealing the terminating ends of said flexible waterproof covering means to the building in proximity to the periphery of the upper supporting surface thereby producing a waterproof insulating roof system.

2. A roof insulation system as set forth in claim 1, including means for securing said first substantially rigid insulation means to said upper supporting surface of the building.

3. A roof insulation system as set forth in claim 2, wherein said means for securing said first substantially rigid insulation means includes adhesive means.

4. A roof insulation system as set forth in claim 3, wherein said first substantially rigid insulation means maintains the lateral position of said second flexible insulation means upon the upper surface of the building.

5. A roof system as set forth in claim 1, including said first substantially rigid insulation means intermittently disposed within said central area for further supporting said flexible waterproof covering means.

6. A roof insulation system as set forth in claim 1, wherein said first substantially rigid insulation means comprises a plurality of blocks of insulation disposed in an abuting relationship about the periphery of the upper supporting surface of the building.

7. A roof insulation system as set forth in claim 1, wherein said second flexible insulation means comprises at least one piece of flexible insulation means abuting an edge of said first substantially rigid insulation means.

8. A roof insulation system as set forth in claim 1, wherein said first substantially rigid insulation means comprises rigid fiberglass insulation.

9. A roof insulation system as set forth in claim 1, wherein said second flexible insulation means comprises flexible fiberglass insulation.

10. A roof insulation system for a building having sidewalls and an upper supporting surface, comprising in combination;

first substantially rigid insulation means disposed about the periphery of the upper supporting surface of the building;

second flexible insulation means disposed within the central area defined by said first substantially rigid insulation means insulating the entire upper supporting surface of the building;

flexible waterproof covering means disposed upon said first and second insulation means with said first insulation means supporting the periphery of said flexible waterproof covering means and with said second insulation means supporting the central area of said flexible waterproof covering means;

said second flexible insulation means having a greater thickness than said first substantially rigid insulation means for tapering said flexible waterproof covering means at the terminal ends of the upper supporting surface; and sealing means for sealing the terminating ends of said flexible water proof covering means to the building in proximity to the periphery of the upper supporting surface thereby producing a waterproof insulating roof system.

11. A roof insulation system as set forth in claim 1, wherein said sealing means includes flashing means secured to the building by mechanical fasteners.

12. A roof insulation system as set forth in claim 1, wherein said flashing means is disposed on the sidewall of the building adjacent the upper supporting surface.

13. A roof insulation system for a building having sidewalls and an upper supporting surface, comprising in combination:

first substantially rigid insulation means disposed about the periphery of the upper supporting surface of the building;

second flexible insulation means disposed within the central area defined by said first substantially rigid insulation means insulating the entire upper supporting surface of the building;

flexible waterproof covering means disposed upon said first and second insulation means with said first insulation means supporting the periphery of said flexible waterproof covering means and with said second insulation means supporting the central area of said flexible waterproof covering means;

sealing means for sealing the terminating ends of said flexible waterproof covering means to the building in proximity to the periphery of the upper supporting surface thereby producing a waterproof insulating roof systems; and said sealing means including flashing means secured by mechanical fasteners to the sidewall of the building adjacent the upper supporting surface with said flexible waterproof covering means extending between the sidewall of the building and said flashing means.

14. A roof insulation system as set forth in claim 1, wherein said flexible waterproof covering means comprises a flexible plastic material.

15. A roof insulation system for a building having sidewalls and an upper supporting surface, comprising in combination:

first substantially rigid insulation means disposed about the periphery of the upper supporting surface of the building;

second flexible insulation means disposed within the central area defined by said first substantially rigid insulation means insulating the entire upper supporting surface of the building;

flexible waterproof covering means disposed upon said first and second insulation means with said first insulation means supporting the periphery of said flexible waterproof covering means and with said second insulation means supporting the central area of said flexible waterproof covering means;

sealing means for sealing the terminating ends of said flexible waterproof covering means to the building in proximity to the periphery of the upper supporting surface thereby producing a waterproof insulating roof system;

at least a portion of said first substantially rigid insulation means being tapered for cooperation with the slope of an existing roof structure; and means for sealing said flexible waterproof covering means with the conventional roof system.

16. A roof insulation system as set forth in claim 15, wherein the conventional roof system has rows of roof covering, and said means for securing said flexible waterproof covering to the conventional roof includes sealing means for sealing the terminal ends of the flexible waterproof covering means between the adjacent rows of roof covering of the conventional flexible roof of the building.

17. The method of forming a roof insulation system on a building having an upper supporting surface, comprising the steps of:

coating the periphery of the upper supporting surface of the building with an adhesive;

depositing a plurality of blocks of substantially rigid insulation on the adhesive to cover the periphery of the upper surface of the building;

laying flexible insulation within the central area of the upper supporting surface defined by the substantially rigid insulation thereby insulating the entire area of the upper supporting surface of the building;

covering the substantially rigid and flexible insulation with a waterproof covering material; and sealing the waterproof covering material to the building in proximity to the periphery of the upper supporting surface of the builidng.

18. The method as set forth in claim 17, wherein the step of laying flexible insulation within the central area of the upper supporting surface of the building comprises unrolling fiberglass insulation on the upper supporting surface of the building.

19. The method as set forth in claim 17, wherein the step of covering the insulation comprises unrolling a flexible waterproof covering material upon the insulation disposed upon the upper supporting surface of the building.

20. The method as set forth in claim 17, wherein the step of sealing the covering material to the building comprises installing flashing to the building with mechanical fasteners in proximity to the periphery of the upper supporting surface of the building.

21. The method as set forth in claim 20, including trimming the excess waterproof covering material at the edge of the flashing.

22. A roof insulation system for a building having sidewalls and an upper supporting surface, comprising in combination:

first substantially rigid insulation means disposed about the periphery of the upper supporting surface of the building;

adhesive means disposed only upon the periphery of the upper supporting surface of the building for securing said first substantially rigid insulation means to the upper supporting surface of the building;

second flexible insulation means disposed within the central area defined by said first substantially rigid insulation means insulating the entire upper supporting surface of the building;

said first substantially rigid insulation means secured to the periphery of the upper supporting surface of the building maintaining the lateral position of said second flexible insulation means with a central portion of the upper surface defined by the said first substantially rigid insulation means of the building;

flexible waterproof covering means disposed upon said first and second insulation means with said first insulation means supporting the periphery of said flexible waterproof covering means and with said second insulation means supporting the central area of said flexible waterproof covering means; and sealing means for sealing the terminating ends of said flexible waterproof covering means to the building in proximity to the periphery of the upper supporting surface thereby producing a waterproof insulating roof system.

* * * * *

UNITED STATES PATENT AND TRADEMARK OFFICE

CERTIFICATE OF CORRECTION

PATENT NO. : 4,424,650

DATED : January 10, 1984

INVENTOR(S) : Van Note

It is certified that error appears in the above-identified patent and that said Letters Patent are hereby corrected as shown below:

Column 2, line 50, delete [insulating] and insert --insulation--.

Column 7, line 13, delete [roof] and insert --roofs--.

Column 7, line 19, delete [insulation] and insert --insulating--.

Signed and Sealed this

*Eleventh* Day of *September 1984*

[SEAL]

*Attest:*

GERALD J. MOSSINGHOFF

*Attesting Officer*

*Commissioner of Patents and Trademarks*